US008393189B1

(12) United States Patent
Lin

(10) Patent No.: US 8,393,189 B1
(45) Date of Patent: Mar. 12, 2013

(54) TUBULAR LOCK AND A KEY FOR THE SAME

(76) Inventor: Sheng-Ting Lin, New Taipei (TW)

( * ) Notice: Subject to any disclaimer, the term of this patent is extended or adjusted under 35 U.S.C. 154(b) by 0 days.

(21) Appl. No.: 13/325,863

(22) Filed: Dec. 14, 2011

(51) Int. Cl.
*E05B 27/00* (2006.01)

(52) U.S. Cl. ..... 70/491; 70/356; 70/404

(58) Field of Classification Search ..... 70/491–493, 70/356, 403, 404
See application file for complete search history.

(56) References Cited

U.S. PATENT DOCUMENTS

| | | | | |
|---|---|---|---|---|
| 3,509,748 | A * | 5/1970 | Trainor | 70/491 |
| 3,648,492 | A * | 3/1972 | Walters et al. | 70/491 |
| 3,903,720 | A * | 9/1975 | Scherbing | 70/491 |
| 3,961,507 | A * | 6/1976 | Falk | 70/491 |
| 4,012,931 | A * | 3/1977 | Harunari | 70/496 |
| 4,069,696 | A * | 1/1978 | Steinbach | 70/491 |
| 4,446,709 | A * | 5/1984 | Steinbach | 70/496 |
| 4,621,510 | A * | 11/1986 | Scherbing | 70/491 |
| 4,735,069 | A * | 4/1988 | Steinbach | 70/491 |
| 5,020,349 | A * | 6/1991 | Lee | 70/491 |
| 5,024,072 | A * | 6/1991 | Lee | 70/491 |
| 5,097,686 | A * | 3/1992 | Plumer | 70/232 |
| 6,038,898 | A * | 3/2000 | Cliff | 70/491 |
| 6,357,271 | B1 * | 3/2002 | Hsu | 70/491 |
| 6,550,299 | B1 * | 4/2003 | Lin | 70/491 |
| 6,584,819 | B1 * | 7/2003 | Hung | 70/491 |
| 6,644,078 | B1 * | 11/2003 | Hung | 70/491 |
| 6,718,808 | B2 * | 4/2004 | Yu | 70/491 |
| 6,895,792 | B2 * | 5/2005 | Davis | 70/278.3 |
| 6,904,775 | B2 * | 6/2005 | Makos et al. | 70/16 |
| 7,234,330 | B2 * | 6/2007 | Tseng | 70/491 |
| 7,260,965 | B2 * | 8/2007 | Hung | 70/339 |
| 7,454,934 | B2 * | 11/2008 | Lin | 70/491 |
| 7,614,268 | B2 * | 11/2009 | Preddey | 70/491 |
| 2004/0231379 | A1 * | 11/2004 | Yu | 70/491 |
| 2006/0096344 | A1 * | 5/2006 | Lee | 70/491 |

FOREIGN PATENT DOCUMENTS

| | | | |
|---|---|---|---|
| GB | 1376011 | A | 12/1974 |
| GB | 1376012 | A | 12/1974 |
| JP | 2009013644 | A | 1/2009 |

OTHER PUBLICATIONS

United Kingdom Intellectual Property Office, Combined Search and Examination Report Under Sections 17 and 18(3) for Application No. GB1121283.4, 10 pages.

* cited by examiner

*Primary Examiner* — Suzanne Barrett
(74) *Attorney, Agent, or Firm* — C. G. Mersereau; Nikolai & Mersereau, P.A.

(57) ABSTRACT

A tubular lock has a casing, a key pin seat, a driving pin seat, at least one positioning assembly, a side pin seat, at least one side positioning assembly and a fastening assembly. The positioning assembly is mounted axially in the key pin seat and is mounted through the driving pin seat. The side positioning assembly is mounted transversely through the casing and the side pin seat. With the installation of the side positioning assembly, the tubular lock can increase the permutation combinations of all the positioning assemblies. With the positioning assembly and the side positioning assembly operating in perpendicular directions to each other, the tubular lock can increase the difficulty of unlocking. With the both features, the tubular lock can enhance safety.

4 Claims, 7 Drawing Sheets

TUBULAR LOCK AND A KEY FOR THE SAME

BACKGROUND OF THE INVENTION

1. Field of the Invention

The present invention relates to a lock, especially to a tubular lock with enhanced safety.

2. Description of the Prior Arts

Lock is a common device to protect property from being stolen, and also a device that needs a key to unlock.

Lock has several different types. Tubular lock is one of the common locks. With reference to FIG. 7, a conventional tubular lock comprises a casing 91, a driving pin seat 92, a key pin seat 93 and multiple positioning assemblies 94. The driving pin seat 92 is mounted rotatably in the casing 91 and has multiple driving pinholes 921. The key pin seat 93 is mounted securely in the casing 91 and has multiple key pin recesses 931. Each positioning assembly 94 is mounted through a corresponding driving pinhole 921 and is mounted in a corresponding key pin recess 931. Each positioning assembly 94 comprises a driving pin 941, a key pin 942 and a resilient element 943. The driving pin 941, the key pin 942 and the resilient element 943 abut against each other in sequence. The driving pin 941 is mounted through the corresponding driving pinhole 921. The key pin 942 is mounted through the corresponding driving pinhole 921 and is mounted in the corresponding key pin recess 931. The resilient element 943 is mounted in the corresponding key pin recess 931.

When the tubular key is used, the key is inserted in the casing 91. The key has multiple recesses with different depths. Those recesses push and move the positioning assemblies 94. When the correct key is inserted, each interface between the driving pin 941 and the key pin 942 aligns with the interface between the driving pin seat 92 and the key pin seat 93. Then the user rotates the key to rotate the driving pin seat 92 with the driving pins 941. The driving pin seat 92 is attached securely to other devices to unlock the tubular lock. When the incorrect key is inserted, each interface between the driving pin 941 and the key pin 942 misaligns with the interface between the driving pin seat 92 and the key pin seat 93 so that the driving pin seat 92 is blocked and is not rotatable relative to the key pin seat 93.

However, the conventional tubular lock has two shortcomings as follows.

First, the more positioning assemblies 94 the tubular lock has, the more permutation combinations of depths the recesses of the key can make. It also takes the thief more time to unlock the conventional tubular lock. However, the amounts of holes and the recesses of the pin seats 92, 93 are limited by the volume of the pin seats 92, 93.

Second, no matter how many positioning assemblies 94 the tubular lock has, all the positioning assemblies 94 are mounted axially. The thief only has to operate in the same direction to unlock the conventional tubular lock.

To overcome the shortcomings, the present invention provides a tubular lock and a key for the same to mitigate or obviate the aforementioned problems.

SUMMARY OF THE INVENTION

The main objective of the present invention is to provide a tubular lock and a key for the same with enhanced safety.

The tubular lock and a key for the same in accordance with the present invention has a casing, a key pin seat, a driving pin seat, at least one positioning assembly, a side pin seat, at least one side positioning assembly and a fastening assembly. The key pin seat is mounted securely in the casing. The driving pin seat is mounted rotatably through the casing. The positioning assembly is mounted axially in the key pin seat and is mounted through the driving pin seat. The side pin seat is mounted rotatably in the casing. The side positioning assembly is mounted transversely through the casing and the side pin seat. With the installation of the side positioning assembly, the tubular lock can increase the permutation combinations of all the positioning assemblies. With the positioning assembly and the side positioning assembly operating in perpendicular directions to each other, the tubular lock can increase the difficulty of unlocking. With the both features, the present invention can enhance safety.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
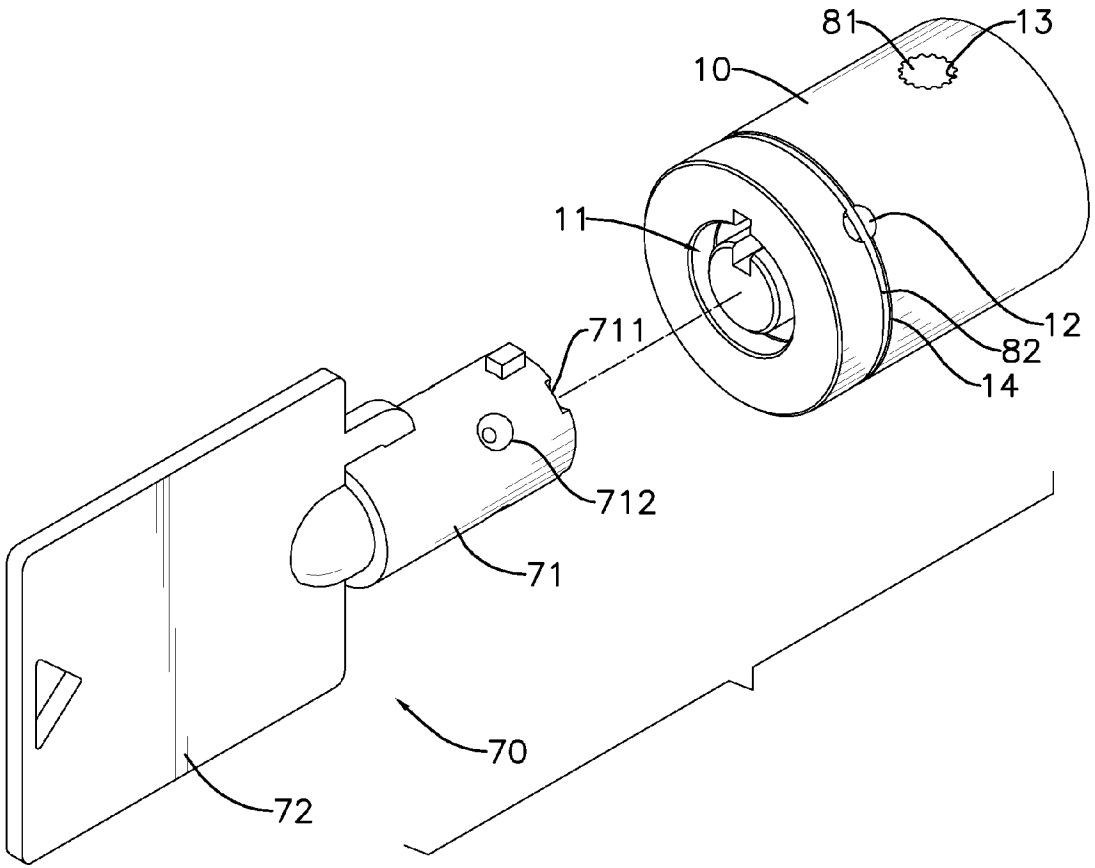
FIG. 1 is a perspective view of a first embodiment of a tubular lock and a key for the same in accordance with the present invention.
Figure 2:
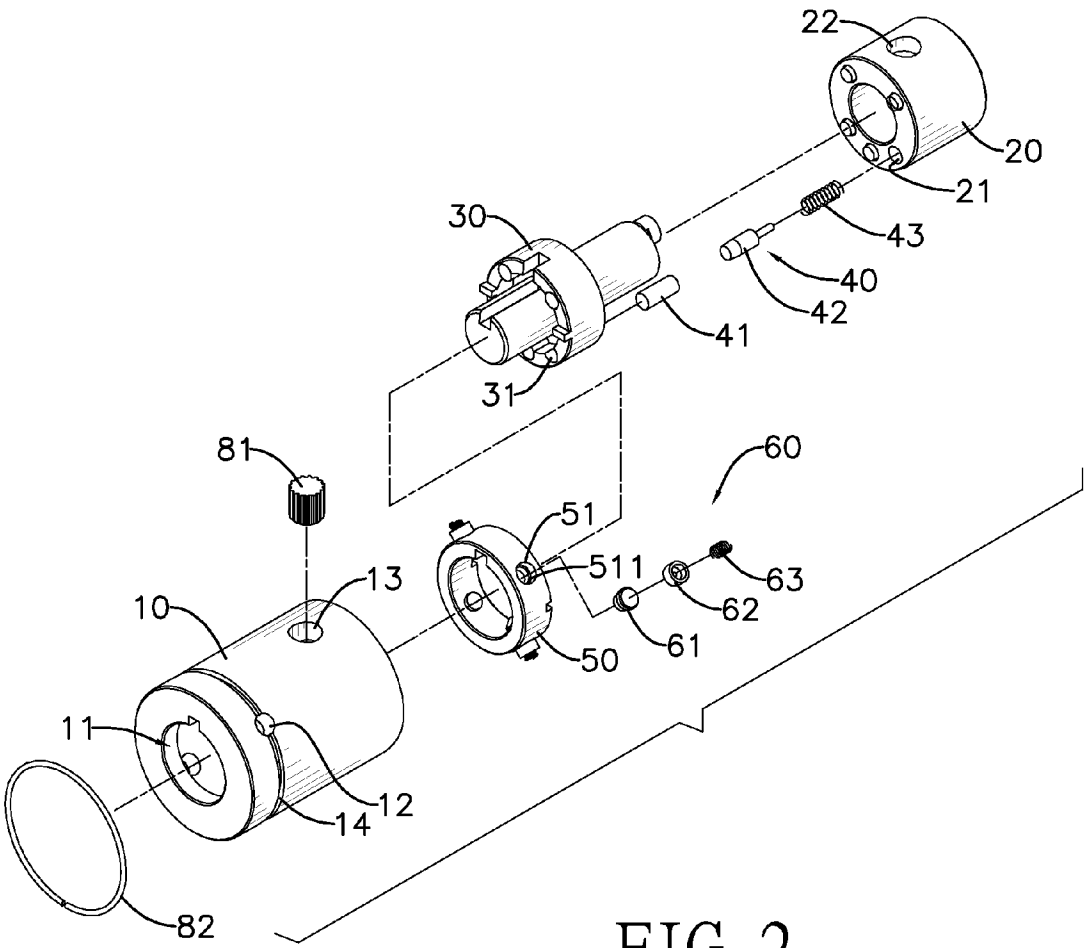
FIG. 2 is an exploded perspective view of a tubular lock and a key for the same in FIG. 1.

With reference to FIGS. 1 and 2, a tubular lock in accordance with the present invention comprises a casing 10, a key pin seat 20, a fastening pin 81, a driving pin seat 30, at least one positioning assembly 40, a side pin seat 50, at least one side positioning assembly 60 and a C-clip 82.

Figure 3:
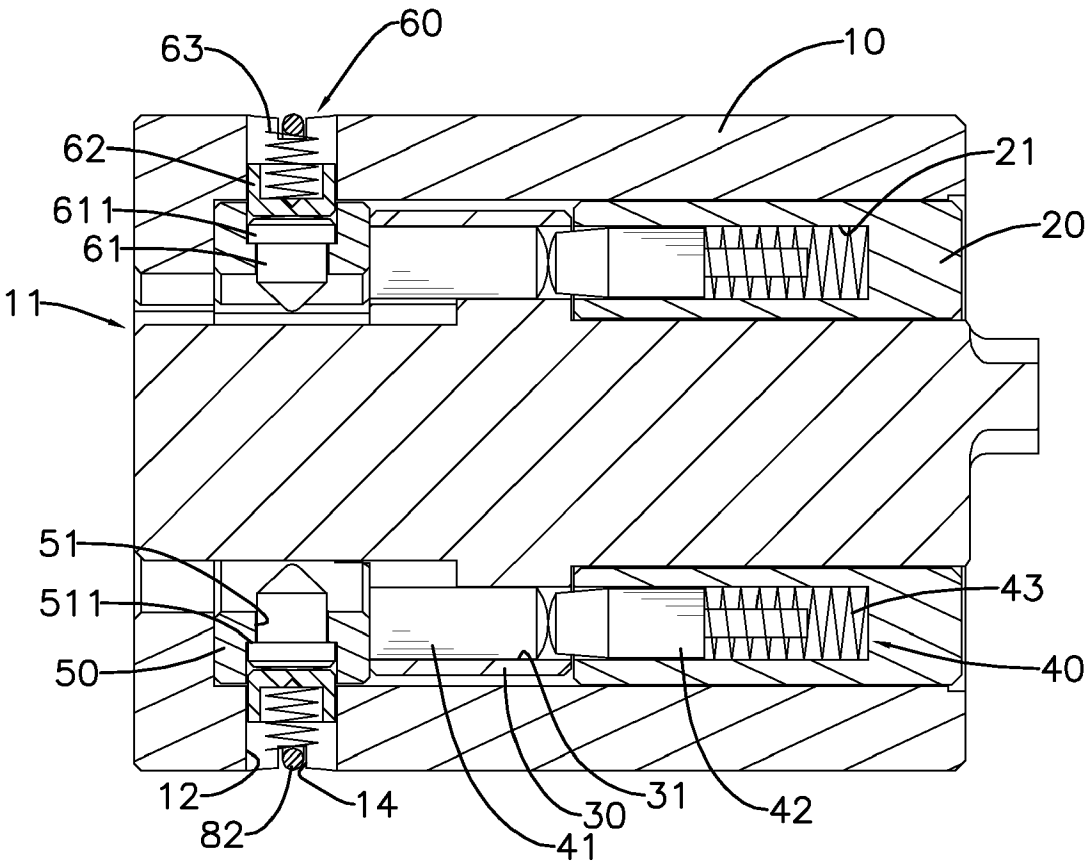
FIG. 3 is a side view in partial section of a tubular lock and a key for the same in FIG. 1.
Figure 4:
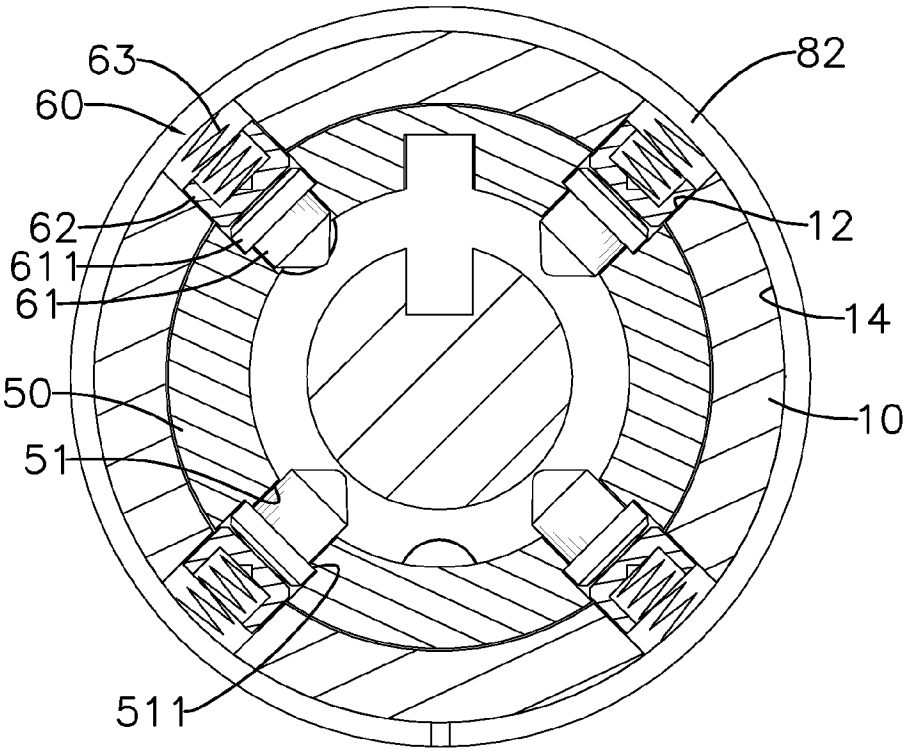
FIG. 4 is a front view in partial section of a tubular lock and a key for the same in FIG. 1.

With reference to FIGS. 2 to 4, the casing 10 has a keyhole 11, at least one outer pinhole 12, an annular groove 14 and a fastening hole 13. The keyhole 11 is formed axially through the casing 10. The at least one outer pinhole 12 is formed transversely through and is formed separately on the casing 10. The annular groove 14 is formed in an outside wall of the casing 10 and communicates with each one of the at least one outer pinhole 12. The fastening hole 13 is formed transversely through the casing 10.

The key pin seat 20 is mounted securely in the casing 10 and has at least one key pin recess 21 and a fastening recess 22. Each one of the at least one key pin recess 21 is formed axially in the key pin seat 20. The fastening recess 22 is formed transversely in the key pin seat 20.

The fastening pin 81 is mounted through the fastening hole 13 of the casing 10 and is mounted securely in the fastening recess 22 of the key pin seat 20.

The driving pin seat 30 is mounted rotatably through the casing 10 and has at least one driving pinhole 31. Each one of the at least one driving pinhole 31 is formed axially through the driving pin seat 30.

Each one of the at least one positioning assembly 40 is mounted through a corresponding driving pinhole 31 of the driving pin seat 30, is mounted in a corresponding key pin recess 21 of the key pin seat 20 and has a driving pin 41, a key pin 42 and a spring 43. The driving pin 41 is mounted through the corresponding driving pinhole 31. The key pin 42 is mounted through the corresponding driving pinhole 31, is mounted in the corresponding key pin recess 21, and abuts against the driving pin 41. The spring 43 is mounted in the corresponding key pin recess 21 and abuts against the key pin 42.

The side pin seat 50 is mounted rotatably in the casing 10. The side pin seat 50 is a loop and has at least one inner pinhole 51. The at least one inner pinhole 51 is formed transversely through and is formed separately on the side pin seat 50. Each one of the at least one inner pinhole 51 has a stepped sidewall 511.

Each one of the at least one side positioning assembly 60 is mounted through a corresponding outer pinhole 12 of the casing 10 and a corresponding inner pinhole 51 of the side pin seat 50, and has an inner pin 61, an outer pin 62 and a spring 63. The inner pin 61 is mounted through the corresponding inner pinhole 51 and has a flange 611. The flange 611 is formed annularly around the inner pin 61 and abuts the stepped sidewall 511 of the corresponding inner pinhole 51 of the side pin seat 50. The outer pin 62 is mounted through the corresponding inner pinhole 51 and the corresponding outer pinhole 12, and abuts against the inner pin 61. The spring 63 is mounted through the corresponding outer pinhole 51 and abuts against the outer pin 62.

The C-clip 82 is mounted around and engages the annular groove 14 of the casing 10 and abuts the spring 63 of each one of the at least one side positioning assembly 60. With reference to FIGS. 1 and 2, a key 70 for the tubular lock in accordance with the present invention comprises an inserting segment 71 and a holding segment 72.

The inserting segment 71 has at least one positioning segment 711 and at least one side positioning segment 712. Each one of the at least one positioning segment 711 is a recess and is formed axially on one end of the inserting segment 71. Each one of the at least one side positioning segment 712 is a recess and is formed transversely on an outside wall of the inserting segment 71.

The holding segment 72 is attached securely to the other end of the inserting segment 71.

With reference to FIGS. 1, 2, 5 and 6, when the tubular lock and the key 70 for the same are used, the key 70 is inserted into the keyhole 11 of the casing 10. Each one of the at least one positioning segment 711 of the key 70 pushes and moves a corresponding positioning assembly 40, and each one of the at least one side positioning segment 712 pushes and moves a corresponding side positioning assembly 60.

Figure 5:
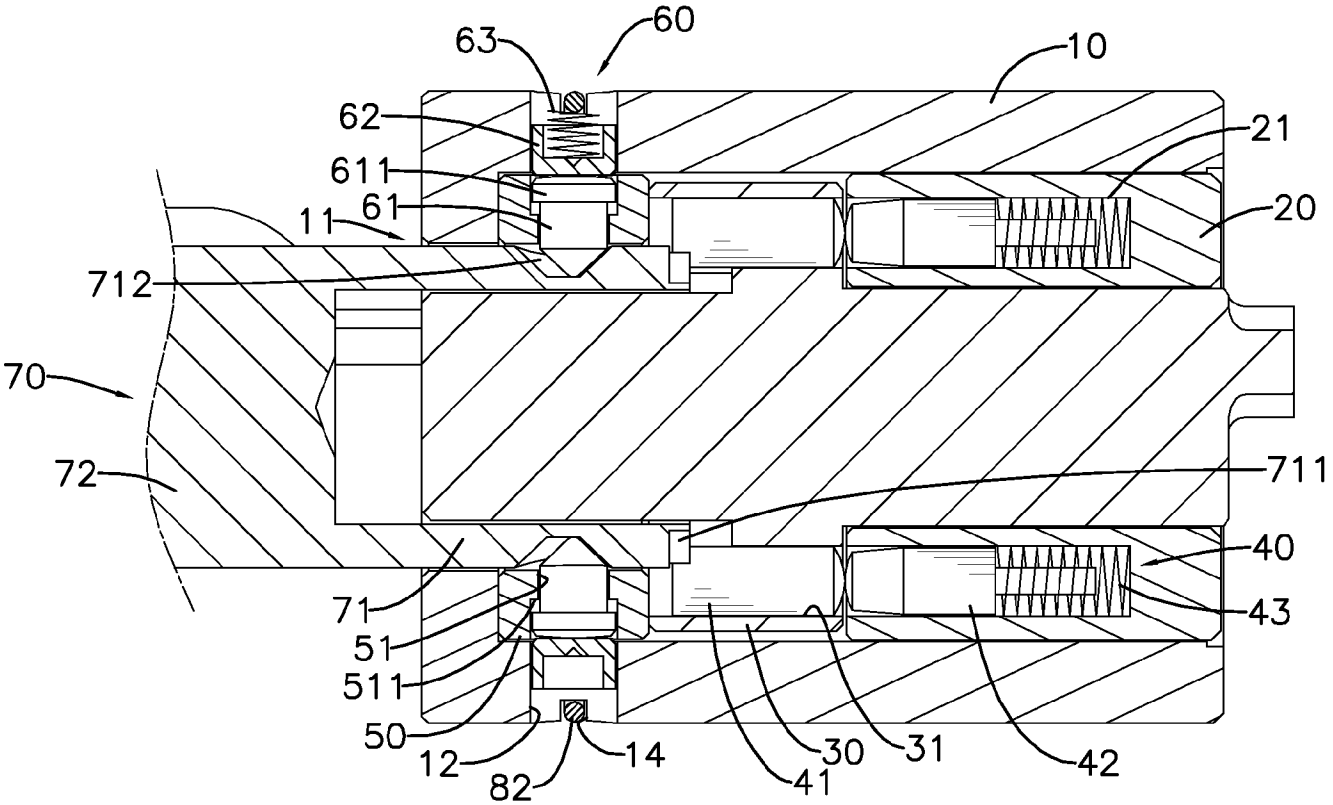
FIG. 5 is an operational side view in partial section of a tubular lock and a key for the same in FIG. 1, showing the key inserted.
Figure 6:
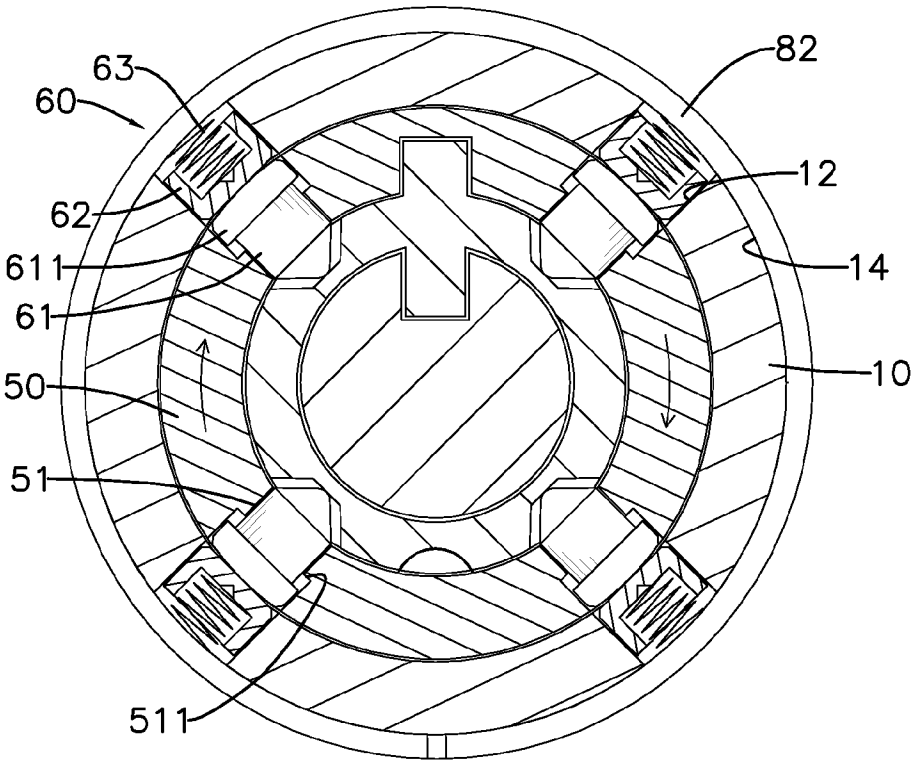
FIG. 6 is an operational front view in partial section of a tubular lock and a key for the same in FIG. 1, showing the key inserted.
Figure 7:
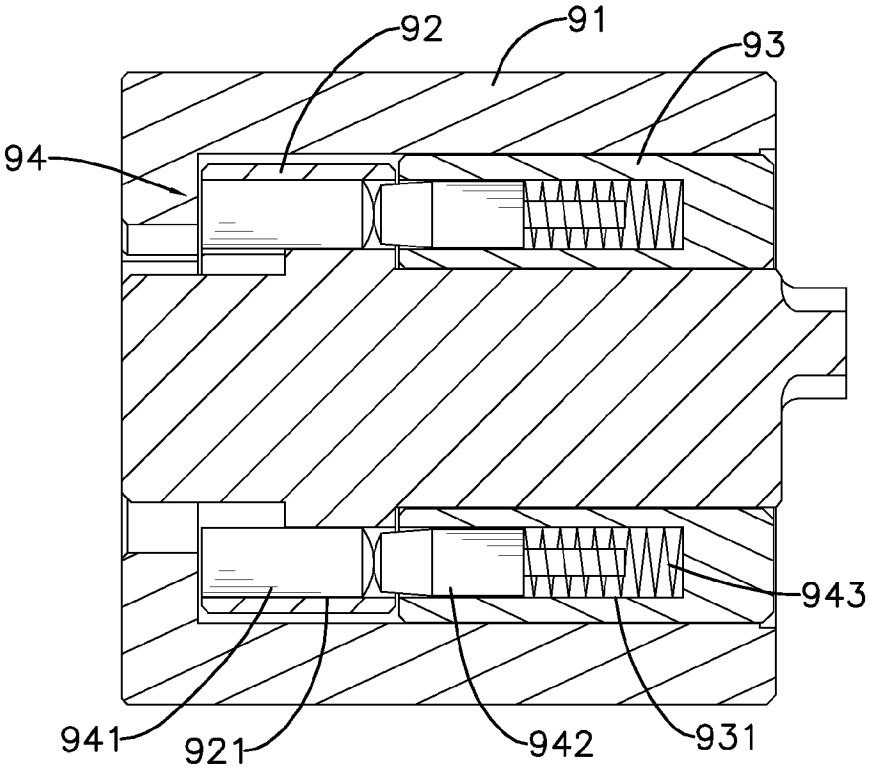
FIG. 7 PRIOR ART
FIG. 7 is a side view in partial section of a conventional tubular lock in accordance with the prior art.

When the correct key 70 is inserted, each interface between the driving pin 41 and the key pin 42 aligns with an interface between the driving pin seat 30 and the key pin seat 20 as shown in FIG. 5. Besides, each interface between the inner pin 61 and the outer pin 62 also aligns with an interface between the casing 10 and the side pin seat 50 as shown in FIG. 6. Then the user rotates the key 70 to rotate the driving pin seat 30 with the driving pin 41 and the side pin seat 50 with the inner pin 61. The driving pin seat 30 is attached securely to other devices to unlock the tubular lock.

When the incorrect key 70 is inserted, each interface between the driving pin 41 and the key pin 42 misaligns with the interface between the driving pin seat 30 and the key pin seat 20 so that the driving pin seat 30 is blocked and is not rotatable relative to the key pin seat 20. Besides, each interface between the inner pin 61 and the outer pin 62 misaligns with the interface between the casing 10 and the side pin seat 50 so that the side pin seat 50 is blocked and is not rotatable relative to the casing 10.

With the aforementioned description, the tubular lock and the key for the same have the following advantages.

First, with the installation of the side positioning assembly 60 in addition to the key pin seat 20 and the driving pin seat 30, the tubular lock can increase the amount of all the positioning assemblies 40, 60 without influencing the positioning assembly 40. Then the permutation combinations of all the positioning assemblies 40, 60 and the difficulty of unlocking are increased, too.

Second, with the positioning assembly 40 and the side positioning assembly 60 operating in perpendicular directions to each other, the thief has to operate in two perpendicular directions, which increases the difficulty of unlocking. For example, when making one tool inserted into the keyhole 11 to push the positioning assembly 40, the keyhole 11 is too full to accommodate another tool to push the side positioning assembly 60. The difficulty of unlocking is therefore enhanced.

With the both features, the present invention has more positioning assemblies 40, 60, and the positioning assemblies 40, 60 can be mounted in different directions. Then the safety of the tubular lock can be effectively enhanced.

In another preferred embodiment, each one of the at least one positioning segment and each one of the at least one side positioning segment are protrusions, and the protrusions push and move the positioning assembly and the side positioning assembly respectively into the right place as well.

In another preferred embodiment, the C-clip is a fastening assembly of another type, and the fastening assembly abuts against the spring of the side assembly.

In another preferred embodiment, the present invention has no fastening pin, and the casing is connected securely to the key pin seat by other means.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A tubular lock comprising:

a casing having a keyhole formed axially through the casing;

at least one outer pinhole formed transversely through and formed separately on the casing; and an annular groove formed in an outside wall of the casing and communicating with each one of the at least one outer pinhole;

a key pin seat mounted securely in the casing and having at least one key pin recess formed axially in the key pin seat;

a driving pin seat mounted rotatably through the casing and having at least one driving pinhole formed axially through the driving pin seat;

at least one positioning assembly mounted through a corresponding driving pinhole of the driving pin seat, mounted in a corresponding key pin recess of the key pin seat, and having a driving pin, a key pin and a resilient element;

a side pin seat mounted rotatably in the casing, being a loop and having at least one inner pinhole formed transversely through and formed separately on the side pin seat, and having at least one stepped sidewall;

at least one side positioning assembly mounted through a corresponding outer pinhole of the casing and a corresponding inner pinhole of the side pin seat, and having an inner pin mounted through the corresponding inner pinhole, and having a flange formed annularly around the inner pin and abutting the stepped sidewall of the corresponding inner pinhole;

an outer pin mounted through the corresponding inner pinhole and the corresponding outer pinhole, and abutting against the inner pin; and a resilient element mounted through the corresponding outer pinhole, and abutting against the outer pin; and a fastening assembly being a C-clip, mounted around and engaging the annular groove of the casing and abutting the resilient element of each one of the at least one side positioning assembly.

2. The tubular lock as claimed in claim 1, wherein the resilient elements of each one of the at least one positioning assembly and each one of the at least one side positioning assembly are springs.

3. The tubular lock as claimed in claim 1 further comprising a fastening pin, wherein the casing has a fastening hole formed transversely through the casing;

the key pin seat has a fastening recess formed transversely in the key pin seat; and the fastening pin is mounted through the fastening hole of the casing, and is mounted securely in the fastening recess of the key pin seat.

4. The tubular lock as claimed in claim 2 further comprising a fastening pin, wherein the casing has a fastening hole formed transversely through the casing;

the key pin seat has a fastening recess formed transversely in the key pin seat; and the fastening pin is mounted through the fastening hole of the casing, and is mounted securely in the fastening recess of the key pin seat.

* * * * *